United States Patent [19]

Propes

[11] Patent Number: 4,955,503

[45] Date of Patent: Sep. 11, 1990

[54] PARTITIONED DRINKING CUP

[76] Inventor: Michael L. Propes, 83 Sandra Ave., Greenville, S.C. 29611

[21] Appl. No.: 305,079

[22] Filed: Feb. 2, 1989

[51] Int. Cl.[5] ..... A47G 19/00

[52] U.S. Cl. ..... 220/526; 229/1.5 B

[58] Field of Search ..... 220/22, 90.4; 229/1.5 B, 906.1; 215/6

[56] References Cited

U.S. PATENT DOCUMENTS

| | | | |
|---|---|---|---|
| 1,706,334 | 3/1929 | Toch | 220/22 |
| 1,970,970 | 8/1934 | Nolan | 220/22 |
| 2,335,016 | 11/1943 | Lorenzen et al. | 220/22 |
| 3,057,536 | 10/1962 | Warnsdorfer, Jr., et al. | 229/1.5 B X |
| 3,081,926 | 3/1963 | Newton | 220/22 X |
| 3,323,706 | 6/1967 | Gereke | 229/1.5 B X |
| 3,400,855 | 9/1968 | Alexander | 220/90.4 |

*Primary Examiner*—Steven M. Pollard

*Attorney, Agent, or Firm*—Cort Flint

[57] ABSTRACT

A souvenir drinking cup (10) is disclosed having a first drinking compartment (10*a*) and a second drinking compartment (10*b*) effectively isolated from each other by a partition (12) and seal (26) when lid (18) is fitted over the open top of the cup. Interfitting parts (34, 36 and 12*a*) align lid (18) so that dispensing outlets (28, 30) are correctly positioned over drinking compartments (10*a*, 10*a*). Handles (32, 34) associated with each drinking compartment provides further positioned dispensing outlets (28, 30) for simultaneous drinking from the souvenir cup by two persons.

7 Claims, 2 Drawing Sheets

PARTITIONED DRINKING CUP

BACKGROUND OF THE INVENTION

The invention relates to a partitioned drinking cup having an interior divided into two liquid-tight compartments from which liquids may be dispensed by two persons simultaneously without co-mingling.

In the past, various types of containers have been provided with dividing walls inside the interior of the container for various purposes. In a very early patent, U.S. Pat. No. 97,583, a drinking cup is divided into two compartments by a middle partition. This drinking cup is divided to contain two different ingredients which may be mixed together in the mouth when discharged from a common point from the cup. Other containers have been provided for purposes other than drinking such as disclosed in U.S. Pat. Nos. 2,731,013 and 1,736,264 with divided compartments and lids. The first patent discloses a container for hypodermic injection ingredients wherein a flat circular disk covers the top of the container formed from a compressible rubber which is readily penetrated by a hypodermic needle. The second patent discloses a jar for containing different commodities in which a sealing compound is applied between the lid and the jar to seal the compartments.

U.S. Pat. No. 4,438,865 discloses a lid for a drinking cup having a tab which may be removed to provide an opening for a drinking straw.

Other patents of general interest are U.S. Pat. Nos. 2,335,016 disclosing a divided capsule container, U.S. Pat. No. 1,184,549 disclosing a divided salt and pepper container, and U.S. Pat. No. 1,164,050 disclosing a divided pail.

The prior art has not provided a suitable drinking cup device having two compartments for containing different liquids so that the liquids may be simultaneously dispensed by two individuals and without co-mingling of the liquid.

Accordingly, an important object of the invention is to provide a partitioned drinking cup having two compartments for containing two liquids and a lid which fits over the compartments to contain the liquids without co-mingling upon being dispensed from the cup.

Another object of the invention is to provide a drinking cup having been partitioned into two compartments sealed by a removable lid having two straw openings for simultaneous dispensing of the liquids without co-mingling.

Yet another object of the invention is to provide a drinking cup having two compartments for containing two liquids and a removable lid which seals the compartments and aligns plural straw openings in proper positions for dispensing from a respective compartment simultaneously.

Another object of the invention is to provide a drinking cup of a souvenir type in which two persons may simultaneously drink different liquids contained in individual compartments in the cup without co-mingling of the liquids wherein handles on the cups may each be engaged by the different persons while a removable lid includes means for sealing the compartments in a liquid-tight manner while orienting plural dispensing openings in the proper compartments for proper dispensing of the liquid by persons holding the handles.

SUMMARY OF THE INVENTION

The above objectives are accomplished according to the present invention by providing a drinking cup divided into two compartments and having a separate handle associated with each compartment and a removable lid having a straw dispensing opening associated with each compartment. Interfitting between the removable lid and the partition wall in the interior of the cup seals off the passage of liquid between the compartments to contain both liquids without co-mingling and also provides proper alignment of the lid on the cup so that the straw openings are positioned correctly in the compartments and in association with each handle. In this manner, each person may hold a handle and dispense a liquid from their associated compartment simultaneously without co-mingling of the liquids.

DESCRIPTION OF THE DRAWINGS

The construction designed to carry out the invention will hereinafter be described, together with other features thereof. The invention will be more readily understood from a reading of the following specification and by reference to drawings forming a part thereof, wherein an example of the invention is shown and wherein.

DESCRIPTION OF A PREFERRED EMBODIMENT

Referring now in more detail to the drawings, a partitioned drinking cup is shown generally at A which includes a container in the form of a cup 10. In the interior of cup 10 is a partition divider wall 12 which divides the cup generally in half to provide separate drinking compartments. There is a first drinking compartment 10*a* and a second drinking compartment 10*b*. An open top 14 is defined by a perimetal rim 16 around the top of cup 10.

Figure 2:
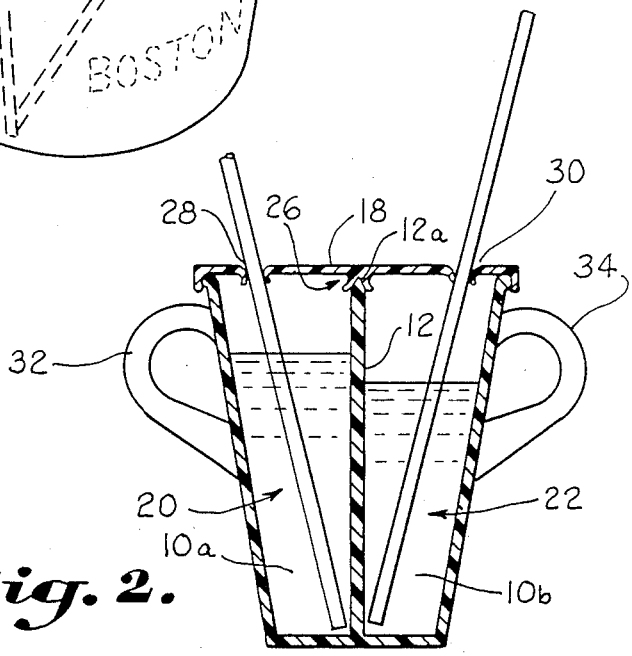
FIG. 2 is a sectional view of a partitioned drinking cup constructed in accordance with the present invention.

As can best be seen in FIG. 2, a removable lid 18 is provided which covers the open top 14 of the drinking cup. Cup 10 and lid 18 are made from a crushable or deformable material such as cardboard and/or a suitable plastic material. In the case of a suitable plastic material, the cup may not be crushable, but may be relatively rigid and only semideformable. A first liquid 20 may be carried in compartment 10*a* and a second liquid 22 may be carried in compartment 10*b*. In a preferred embodiment, the cup is provided as a souvenir cup and may include suitable indicia 24, for example, one compartment may be labeled with one athletic team and the other compartment may be labeled with a second athletic team which are rivals. Another advantageous use for the cup is that of a dating souvenir where the compartments may be identified as his and her compartments. In any case, the partitioned cup according to the invention is highly advantageous for containing and dispensing two different liquids simultaneously and generally without mixture of the liquids.

As can best be seen in FIG. 2, a sealing means B is provided between lid 18 and partition wall 12 of cup 10 to prevent the liquids from intermixing from one compartment to the other as the cup may be tilted for drinking. As illustrated, sealing means B includes a rib means 26 which extends diametrically across the underneath side of lid 18 to engage an upper edge 12*a* of partition 12 to seal against the passage of liquid therebetween.

Figure 1:
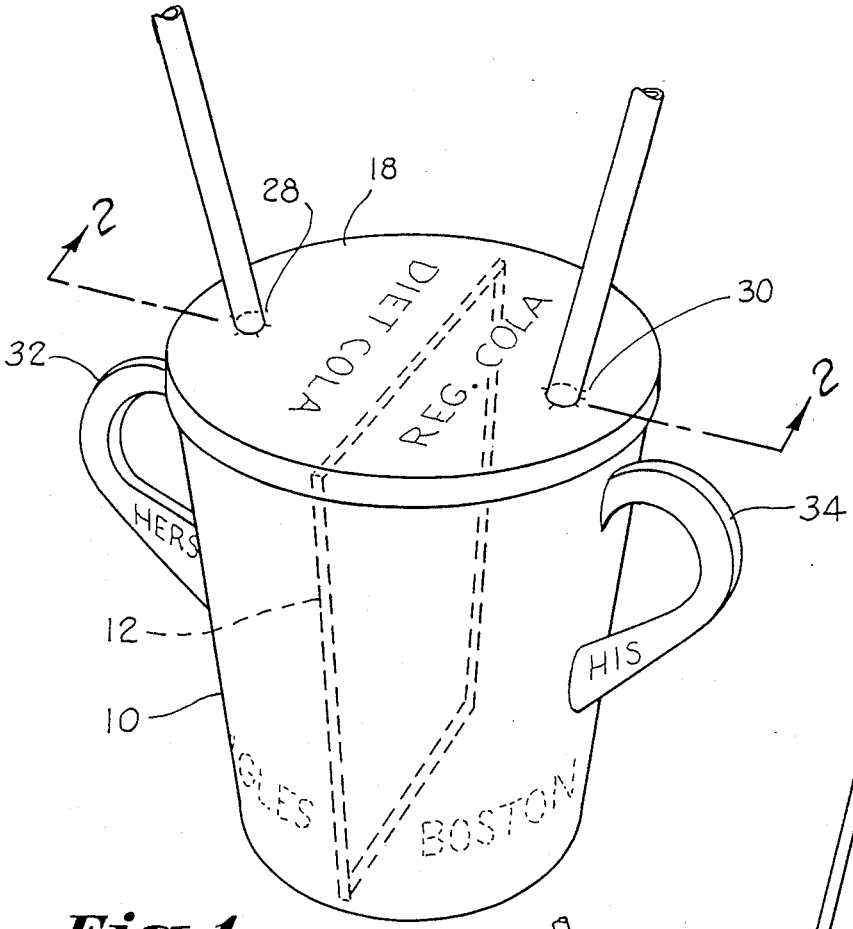
FIG. 1 is a perspective view of a partitioned drinking cup constructed in accordance with the present invention.
Figure 3:
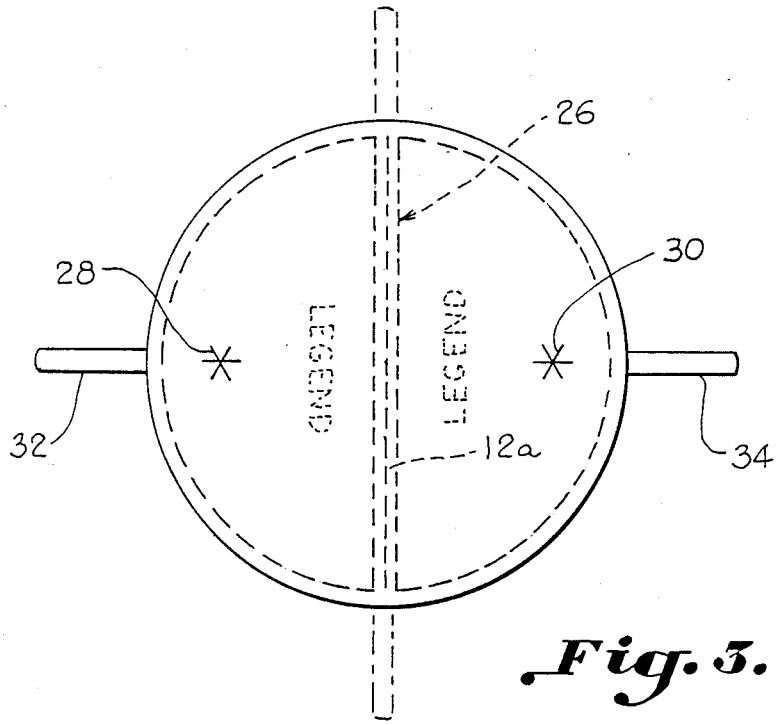
FIG. 3 is a top plan view of a lid for a partitioned drinking cup constructed in accordance with the present invention.

As can best be seen in FIG. 3, opening means is provided for penetration of drinking straws through lid 18. Opening means preferably comprises a perforated opening 28 on one side of rib means 26 and a second perforated opening 30 on the opposite side of rib means 26. It is to be understood, of course, that permanent holes as well as perforated holes which are deformed by penetration of a straw may be used on the lid for dispensing openings. It is also noted that an important advantage of the present invention is rib means 26 located over upper edge 12*a* of partition 12 aligning and orienting dispensing openings 28 and 30 over a respective compartment 10*a* and 10*b* for correct dispensing. As can best be seen in FIG. 1, handles are provided for simultaneously being held by two persons which are drinking from the cup. There is handle 32 which is associated with compartment 10*a* and a handle 34 which is associated with compartment 10*b*. With placement of lid 18 on the drinking cup, the alignment means provided by rib 26 over edge 12*a* automatically locates the associated handle and dispensing opening with a prescribed compartment.

Figure 4:
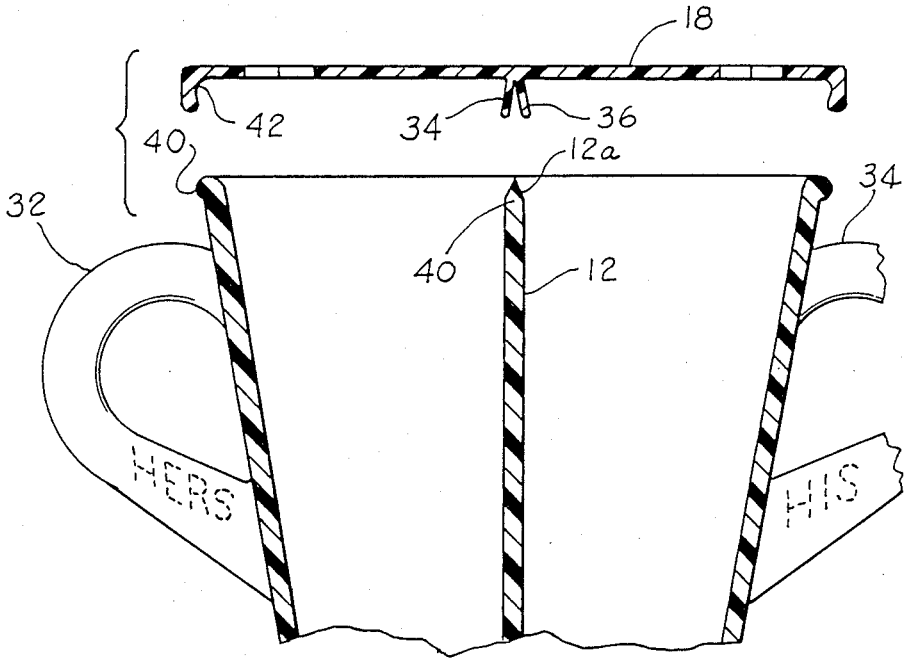
FIG. 4 is a top plan view of a partitioned drinking cup constructed in accordance with the present invention with the lid removed.

In a preferred embodiment, as can best be seen in FIGS. 2 and 4, sealing means B includes rib means 26 in the form of a forked rib having two prongs 34 and 36 which define an inverted "V" 38 over upper edge 12*a* of partition 12. In this case, upper edge 12*a* of partition 12 includes an apex portion 40 which conforms to the shape of inverted "V" 38 so that the two interfit and form a seal while properly aligning the lid. The parts may also be reversed, that is, the forked shape may be provided on the top of partition 12 and the apex portion may be provided in the form of rib 26 so it interfits into the partition. It is particularly advantageous that the sealing parts interfit so that lid 18 is always fitted on cup 10 in a correct position for proper alignment of dispensing openings over the respective separated compartments. While other structures may be suitable for sealing between the lid and partition, for example, a resilient sealing strip may be fitted along and against the upper edge of partition 12, these parts may be misaligned when being fitted together causing loss of sealing effect as well as misalignment of the straw openings. Thus, it becomes particularly advantageous when the parts are interfitted that they seal and align the lid elements and cup.

As can best be seen in FIG. 4, means provided for which includes a protuberance or bead 40 around rim 16 in a correspondingly contoured recess 42 about the inside of lid 18 which interlock together and form a seal to prevent liquid seepage.

While a preferred embodiment of the invention has been described using specific terms, such description is for illustrative purposes only, and it is to be understood that changes and variations may be made without departing from the spirit or scope of the following claims.

What is claimed is:

1. A partitioned personal drinking cup for simultaneously dispensing two different beverages to first and second persons without co-mingling comprising:

an open top container;

a partitioned wall dividing said container into a first drinking compartment for containing a first drink, and a second drinking compartment for containing a second drink;

a removable lid fitted over said open top of said container;

a first personal drink dispensing opening formed in a first part of said removable lid near a rim of said lid, and a second personal dispensing opening formed in a second part of said drinking lid near said rim of said lid;

said first and second dispensing openings being formed in said lid so that said first dispensing opening overlies said first drinking compartment in a centralized location and said second dispensing opening overlies said second drinking compartment in a centralized location when fitted over said open top of said container so that said first drink may be consumed directly by a first person and said second drink may be consumed directly by a second person; and seal means for forming a seal between said lid and an upper edge of said partition to prevent liquids from mixing between said first and second drinking compartments which includes a first part carried by said lid and a second part carried by said partition wall, and said first part and said second parts interfit together to provide an alignment means which prevents rotational motion between said lid and said cup so that said lid is secured over said open top of said cup in a correct position properly aligning said first and second dispensing openings over said first and second drinking compartments;

a first handle to be held by said first person while drinking from said first compartment of said cup, and a second handle held by said second person while drinking from said second drinking compartment of said cup; and said first dispensing opening being associated with said first handle and said second dispensing opening being associated with said second handle whereby placement of said lid on said cup may be had in a proper position by referencing said first and second dispensing openings to said first and second handles facilitating proper placement of said seal means and said alignment means and centralized location of said dispensing openings relative to said drinking compartments.

2. The sealing means of claim 1 wherein one of said first and second parts comprises a pair of diverging prongs which form a generally V-shaped opening, and the other of said first and second parts comprises a generally pointed part which is received in said V-shaped opening to form said seal.

3. The device of claim 2 wherein said first part is carried by said lid and said second part is carried by said upper edge of said partition wall.

4. The device of claim 1 wherein said exterior of said cup about said first drinking compartment includes indicia associated with said first drinking compartment, and said second drinking compartment carried second indicia which is associated with said second drinking compartment.

5. The device of claim 1 wherein said lid further includes a perimetal rim which interlocks with a perimetal rim of said container to form a seal around the circumference of said lid and container.

6. The device of claim 1 wherein said cup is constructed from a deformable material.

7. The device of claim 1 wherein said first and second handles are in 180 degrees alignment with said first and second drink dispensing openings.

* * * * *